US010774609B2

(12) United States Patent
Rakhunde

(10) Patent No.: US 10,774,609 B2
(45) Date of Patent: Sep. 15, 2020

(54) STRING ASSEMBLY SYSTEM AND METHOD

(71) Applicant: Cameron International Corporation, Houston, TX (US)

(72) Inventor: Vikas Rakhunde, Cypress, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 16/228,119

(22) Filed: Dec. 20, 2018

(65) Prior Publication Data

US 2020/0199964 A1 Jun. 25, 2020

(51) Int. Cl.

| | |
|---|---|
| ***E21B 17/02*** | (2006.01) |
| ***E21B 17/05*** | (2006.01) |
| ***E21B 33/072*** | (2006.01) |
| ***E21B 43/26*** | (2006.01) |

(52) U.S. Cl.

CPC ..... *E21B 33/072* (2013.01); *E21B 43/26* (2013.01)

(58) Field of Classification Search

None

See application file for complete search history.

(56) References Cited

U.S. PATENT DOCUMENTS

| | | | | |
|---|---|---|---|---|
| 3,212,581 | A | 10/1965 | Marshall | |
| 9,260,924 | B2 * | 2/2016 | Collins | E21B 43/128 |
| 2011/0073315 | A1 * | 3/2011 | Guesnon | E21B 17/085 166/367 |

* cited by examiner

*Primary Examiner* — Matthew R Buck
*Assistant Examiner* — Douglas S Wood
(74) *Attorney, Agent, or Firm* — Helen Raybaud

(57) ABSTRACT

A string assembly system that includes a first conduit defining a first end and a second end. A second conduit defining a third end and a fourth end. A first connector assembly coupled to the second end of the first conduit. The first connector assembly includes a first connector shaft that rotates relative to the first conduit and the second conduit. A first alignment shaft that axially aligns the first conduit and the second conduit. A second connector assembly couples to the third end of the second conduit. The second connector assembly couples to the first connector shaft, and the first conduit rotates relative to the second conduit.

20 Claims, 6 Drawing Sheets

STRING ASSEMBLY SYSTEM AND METHOD

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Once a desired subterranean resource is discovered, drilling and production systems are employed to access and extract the resource. These systems may be located onshore or offshore depending on the location of a desired resource. Such systems generally include a wellhead assembly through which the resource is extracted. These wellhead assemblies may include a wide variety of components, such as various casings, valves, fluid conduits, that control drilling or extraction operations.

These wellhead assemblies may also include a fracturing tree and other components to facilitate a fracturing process and enhance production from a well. As will be appreciated, resources such as oil and natural gas are generally extracted from fissures or other cavities formed in various subterranean rock formations or strata. To facilitate extraction of these trapped resources, a well may be subjected to a fracturing process that creates one or more man-made fractures in a rock formation. These man-made fractures may connect to pre-existing fissures and cavities enabling oil and gas to flow into the wellbore. The fracturing process may include perforating the rock formation with charges and then injecting a pressurized fracturing fluid into the well. The high pressure of the fluid increases crack size and crack propagation through the rock formation to release oil and gas, while the proppant prevents the cracks from closing once the fluid is depressurized. In order to create the perforations, a tool lowers the charges to a desired well depth. After perforating the rock formation with the charges, the tool is removed from the well and the well is pressurized to increase crack propagation. The tool is inserted into and withdrawn from the well through a series of connected pipes coupled to the fracturing tree. These connected pipes may be referred to as a lubricator. Unfortunately, assembly and disassembly of the lubricator may be cumbersome and time consuming.

SUMMARY

Certain aspects of some embodiments disclosed herein are set forth below. It should be understood that these aspects are presented merely to provide the reader with a brief summary of certain forms the disclosure might take and that these aspects are not intended to limit the scope of the disclosure. Indeed, the disclosure may encompass a variety of aspects that may not be set forth below.

In one embodiment, a string assembly system includes a first conduit defining a first end and a second end, and a second conduit defining a third end and a fourth end. A first connector assembly is coupled to the second end of the first conduit. The first connector assembly includes a first connector shaft that rotates relative to the first conduit and the second conduit, and a first alignment shaft that axially aligns the first conduit and the second conduit. A second connector assembly is coupled to the third end of the second conduit. The second connector assembly couples to the first connector shaft, and the first conduit rotates relative to the second conduit.

In another embodiment, a string assembly system includes a first connector assembly that couples to a first conduit. The first connector assembly includes a first connector shaft that rotates relative to the first conduit and to a second conduit. A second connector assembly is coupled to the second conduit. The second connector assembly couples to the first connector shaft to enable the first conduit to rotate relative to the second conduit.

In another embodiment, a method of assembling a string includes rotating a first conduit relative to a second conduit. The first conduit and the second conduit couple together with a first connector shaft. The method axially aligns the first conduit and the second conduit along a longitudinal axis of the first conduit. The method drives the first alignment shaft into a first receptacle.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Reference will now be made in detail to specific embodiments illustrated in the accompanying drawings and figures. In the following detailed description, numerous specific details are set forth in order to provide a thorough understanding of the disclosure. However, it will be apparent to one of ordinary skill in the art that embodiments may be practiced without these specific details. In other instances, well-known methods, procedures, components, have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the present disclosure.

The terminology used herein is for the purpose of describing particular embodiments only and is not intended to be limiting. As used in the description and the appended claims, the singular forms "a," "an" and "the" are intended to include the plural forms as well, unless the context clearly indicates otherwise. It will also be understood that the term "and/or" as used herein refers to and encompasses any and possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

The description below includes a string assembly system that facilitates assembly of a plurality of conduits (e.g., pipes) into a string that define a common passage. For example, the string assembly system may enable rapid assembly of a lubricator for fracing, a string for drilling, etc. The string assembly system may also facilitate disassembly, transportation, storage, etc. of a plurality of conduits. As will be explained below, the string assembly system includes connector assemblies that enable multiple conduits to couple together prior to complete assembly of a string. The connector assemblies also facilitate alignment and rapid final assembly of the conduits into a string.

Figure 1:
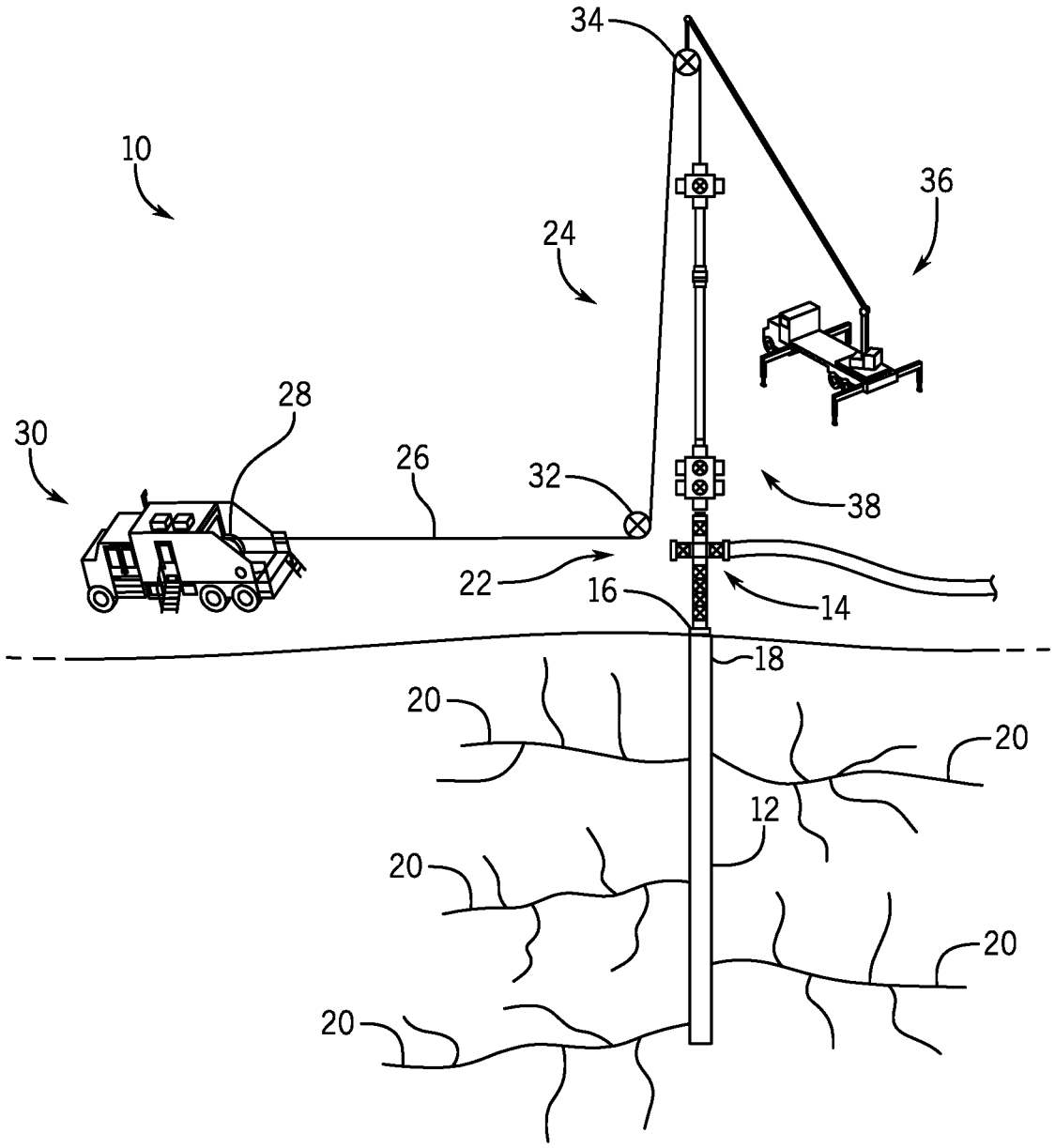
FIG. 1 is an illustration of a hydraulic fracturing system with a lubricator in accordance with an embodiment of the present disclosure.

FIG. 1 is an illustration of a hydrocarbon extraction system 10 capable of hydraulically fracturing a well 12 to extract various minerals and natural resources (e.g., oil and/or natural gas). The system 10 includes a frac tree 14 coupled to the well 12 via a wellhead hub 16. In embodiments, the wellhead hub 16 includes a large diameter hub disposed at the termination of a well bore 18 and is designed to connect the frac tree 14 to the well 12. The frac tree 14 may include multiple components that enable and control fluid flow into and out of the well 12. For example, the frac tree 14 may route oil and natural gas from the well 12, regulate pressure in the well 12, and inject chemicals into the well 12.

The well 12 may have multiple formations at different locations. In order to access each of these formations (e.g., hydraulically fracture), the hydrocarbon extraction system may use a downhole tool coupled to a tubing (e.g., coiled tubing, conveyance tubing). In operation, the tubing pushes and pulls the downhole tool through the well 12 to align the downhole tool with each of the formations. Once the tool is in position, the tool prepares the formation to be hydraulically fractured by plugging the well 12 and boring through the casing. For example, the tubing may carry a pressurized cutting fluid that exits the downhole tool through cutting ports. After boring through the casing, frac fluid (e.g., a combination of water, proppant, and chemicals) may be pumped into the well 12 at high pressures.

As the frac fluid pressurizes the well 12, the frac fluid fractures the formations releasing oil and/or natural gas by propagating and increasing the size of cracks 20. Once the formation is hydraulically fractured the well 12 is depressurized by reducing the pressure of the frac fluid and/or releasing frac fluid through valves 22 (e.g., wing valves). In operation, the valves 22 control the flow of pressurized fluid into and out of the well 12, as well as the insertion and removal of tools.

To facilitate insertion of tools into the well 12, a lubricator 24 couples to the fracturing tree 14. The lubricator 24 is an assembly of conduits coupled together to form a passage (e.g., axial passage). Various tools may be placed within this passage for insertion into and retrieval from the well 12. These tools may include logging tools, perforating guns, plugging tools, among others. For example, a perforating gun may be placed in the lubricator 24 for insertion in the well 12. After performing downhole operations (e.g., perforating the casing), the tool is withdrawn back into the lubricator 24 with a wireline 26.

The wireline 26 extends and retracts in response to rotation of a reel 28. In operation, the reel 28 rotates to wind and unwind the wireline 26. In embodiments, the wireline 26 and reel 28 may be carried on a wireline truck 30 along with a motor that controls rotation of the reel 28. In order to position and orient the wireline 26, the wireline 26 may pass through one or more pulley's 32, 34. As illustrated, the pulley 34 is suspended with a crane 36 above the lubricator 34. In this position, the wireline 26 is able enter and exit the lubricator 34 in a vertical orientation, which facilitates insertion and retraction of tools while also reducing friction and wear on the wireline 26.

As explained above, the lubricator 24 is an assembly of multiple conduits that couple together to form a string with a common passage that receives the wireline 26 and tools. To facilitate assembly of the lubricator 24, the lubricator 24 may be formed with a string assembly system 38. As will be explained below, the string assembly system 38 includes connector assemblies that enable multiple conduits to couple together in a non-axial layout (e.g., not end-to-end), while still sequentially ordering the conduits. More specifically, the string assembly system 38 enables the conduits 60 to couple together prior to complete assembly of a string, such as the lubricator 24. And during assembly, the string assembly system 38 facilitates alignment and rapid final assembly of the conduits into a string.

Figure 2:
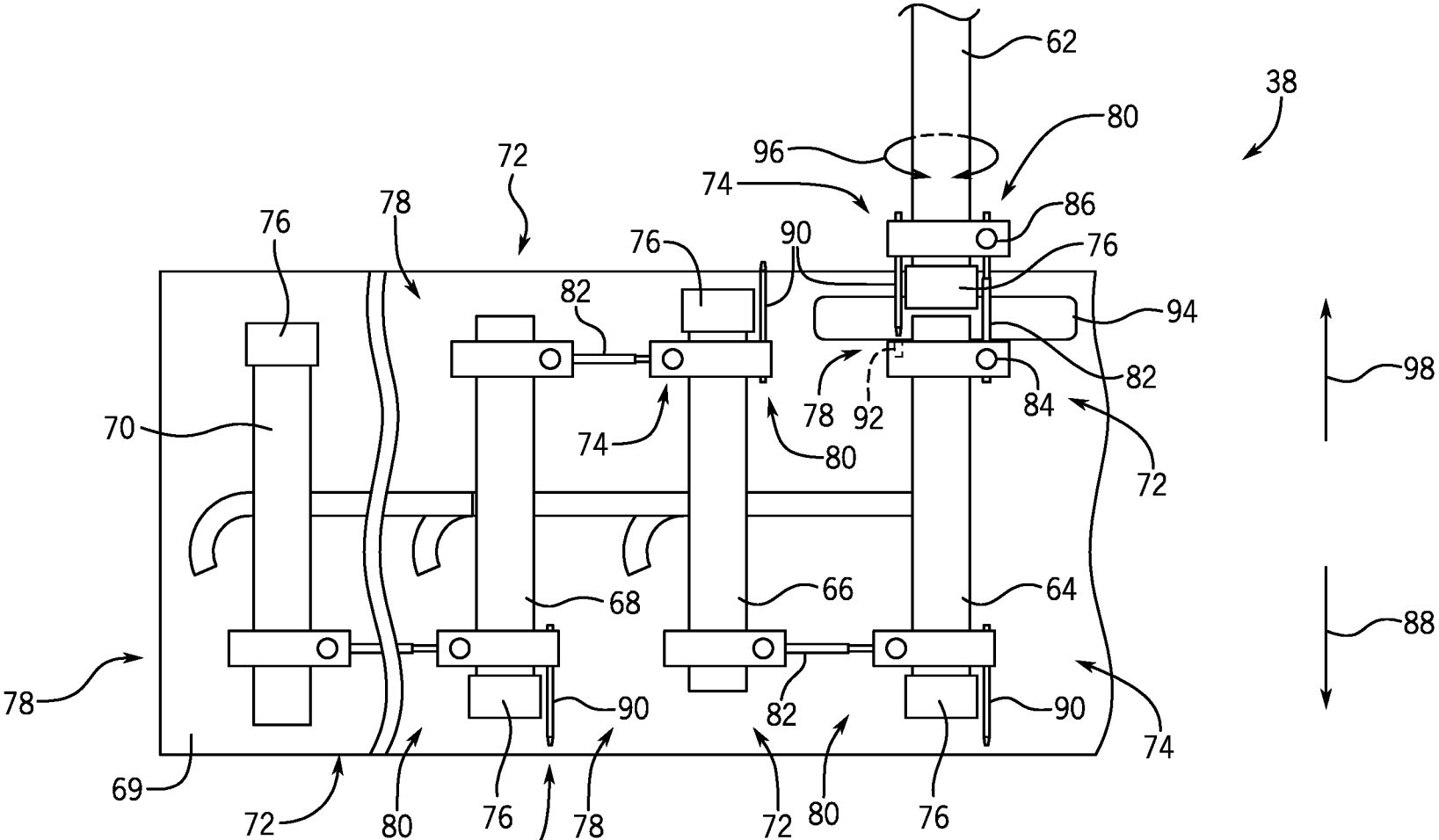
FIG. 2 is a side view of a string assembly system in accordance with an embodiment of the present disclosure.

FIG. 2 is a side view of a string assembly system 38. The string assembly system 38 includes a plurality of conduits 60 numbered 62, 64, 66, 68, and 70. While five conduits 60 are illustrated, it should be understood that the string assembly system 38 may include additional conduits (e.g., 10, 20, 50, 100, 1000, or more). The string assembly system 38 may also include less than the illustrated five conduits 60 (e.g., 2, 3, 4). The conduits 60 are supported on a base 69 that organizes the conduits 60, facilitates transport, and enables rapid assembly of the conduits 60 into a string.

In order to couple the conduits 60 together, the string assembly system 38 includes first connector assemblies 72 (e.g., first clamp assemblies) and second connector assemblies 74 (e.g., second clamp assemblies), and connector 76 (e.g., threaded connector). As illustrated, the first connector assemblies 72 couple to first ends 78 (e.g., end portions) of the conduits 60, the second connector assemblies 74 couple to second ends 80 (e.g., end portions) of the conduits 60, and the connectors 76 couple to the second ends 80 of the conduits 60. In some embodiments, the first conduit 62 and the last conduit 70 may not include a respective first connector assembly 72 and a second connector assembly 74. The absence of these connector assemblies may facilitate coupling of the first conduit 62 and the last conduit 70 to other components of the mineral extraction system 10.

As illustrated, the conduits 60 are coupled together in sequential order with connector shafts 82 (e.g., telescoping shafts) that couple to and extend between the respective first connector assemblies 72 of a conduit and the second connector assemblies 74 of the following one. More specifically, in embodiments, the connector shafts 82 are coupled to respective pins 84 of the first connector assembly 72 and respective pins 86 of the second connector assemblies 74. In this way, the conduits 60 may be coupled together without the need for being axially aligned (e.g., without being coaxial or arranged end-to-end) and/or completely assembled. For example, the conduits 60 may be placed next to each other in a parallel layout or substantially parallel layout when not in use. This may facilitate transport of the conduits 60 while simultaneously coupling the conduits 60 together (i.e., in sequential order) for rapid assembly at a designated site.

In embodiments, in order to assemble the conduits 60 into a string, the first conduit 62 and/or the second conduit 64 might be rotated about their respective hinge pins 86 and 84 (e.g., rotated about an axis perpendicular to a central axis of the respective conduit 62, 64) until the second end 80 of the first conduit 62 is substantially aligned with (e.g., coaxial) the first end 78 of the second conduit 64. Once substantially aligned, the first conduit 62 is driven in axial direction 88. As the first conduit 62 moves in axial direction 88, an alignment shaft 90 on the second connector assembly 74 slides into a receptacle 92 on the first connector assembly 72. The alignment shaft 90 and corresponding receptacle 92 facilitate axial alignment of the second end 80 of the first conduit 62 with the first end 78 of the second conduit 64. After aligning the first conduit 62 with the second conduit 64, the connector 76 couples the second end 80 with the first end 78. For example, a rotating drive 94 may rotate the connector 76 (clockwise or counterclockwise) to threadingly engage the first end 78 of the second conduit 64, thereby coupling the first conduit 62 to the second conduit 64.

It should be understood that instead of the first conduit 62 moving in direction 88, the second conduit 64 may be driven in direction 98 in order to drive the alignment shaft 90 into the receptacle 92. In some embodiments, both the first conduit 62 and the second conduit 64 may be axially driven towards one another. That is, the first conduit 62 may be driven in axial direction 88 and the second conduit 64 may be driven in axial direction 98 in order to drive the alignment shaft 90 into the receptacle 92. It should also be understood that the alignment shaft 90 may couple to the first connector assembly 72 and the second connector assembly 74 may define the receptacle 92. In some embodiments, the connectors 76 may couple to the second ends 80 of the conduits 60 instead of the first ends 78, prior to the coupling of the conduits 60 into a string.

Figure 3:
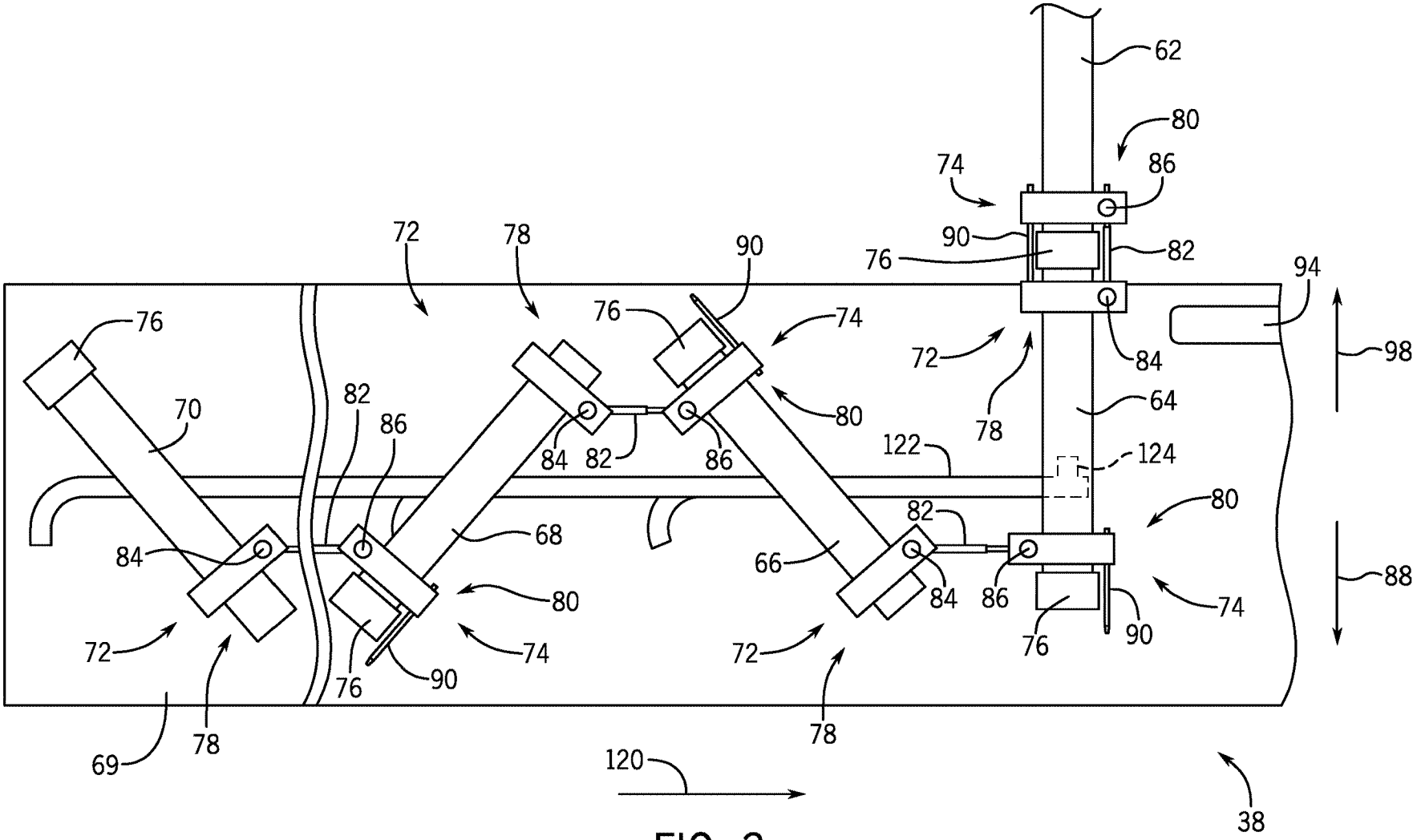
FIG. 3 is a side view of the string assembly system of FIG. 2 in accordance with an embodiment of the present disclosure.

FIG. 3 is a side view of the string assembly system 38. As illustrated, the first conduit 62 and the second conduit 64 are coupled together with the connector 76. After assembling the first conduit 62 to the second conduit 64, both the first conduit 62 and the second conduit 64 are driven in direction 98. As the second conduit 64 moves in axial direction 98, the second conduit 64 separates from the base 69 via a track outlet 124 of a track 122.

As the first conduit and second conduits 62, 64 continue to move in direction 98, the second connector assembly 74 at the second end 80 of the second conduit 64 pulls the first connector assembly 72 coupled to the first end 78 of the third conduit 66 with the connector shaft 82. In response, the third conduit 66 may rotate as well as slide in direction 120 along the track 122 towards the track outlet 124. The movement of the third conduit 66 in direction 120 likewise pulls the remaining conduits 60 in direction 120, as the connector shafts 82 block separation of the first connector assemblies 72 from the second connector assemblies 74.

The first and second conduits 62 and 64 continue to move in direction 98 to rotate the third conduit 66 about the pin 84 until the third conduit 66 is substantially aligned (e.g., coaxial) with the second end 80 of the second conduit 64. Once aligned, the first conduit 62 and the second conduit 64 are driven in axial direction 88. As the first and second conduits 62, 64 move in axial direction 88, an alignment shaft 90 on the second connector assembly 74 of the second conduit 64 slides into a receptacle 92 on the first connector assembly 72 of the third conduit 66. As alignment shaft 90 enters the corresponding receptacle 92, the second end 80 of the second conduit 64 aligns with the first end 78 of the third conduit 66. After aligning the second conduit 64 with the third conduit 66, the connector 76 couples the second end 80 of the second conduit 64 with the first end 78 of the third conduit 66. For example, a rotating drive 94 may rotate the connector 76 in circumferential directions 96 (e.g., clockwise or counterclockwise) to threadingly couple the second conduit 64 to the third conduit 66.

After coupling the second conduit 64 to the third conduit 66, the first conduit 60, the second conduit 64, and the third conduit 66 are driven in axial direction 98. As the third conduit 66 moves in axial direction 98, the third conduit 66 separates from the base 69 via the track outlet 124 of the track 122. The same process described above, occurs with the fourth conduit 68, the fifth conduit 70, and any number of additional conduits 60 enabling the string assembly system 38 to rapidly form a string from the conduits 60. For example, the string assembly system 38 may rapidly form a lubricator 24 for the mineral extraction system 10.

Figure 4:
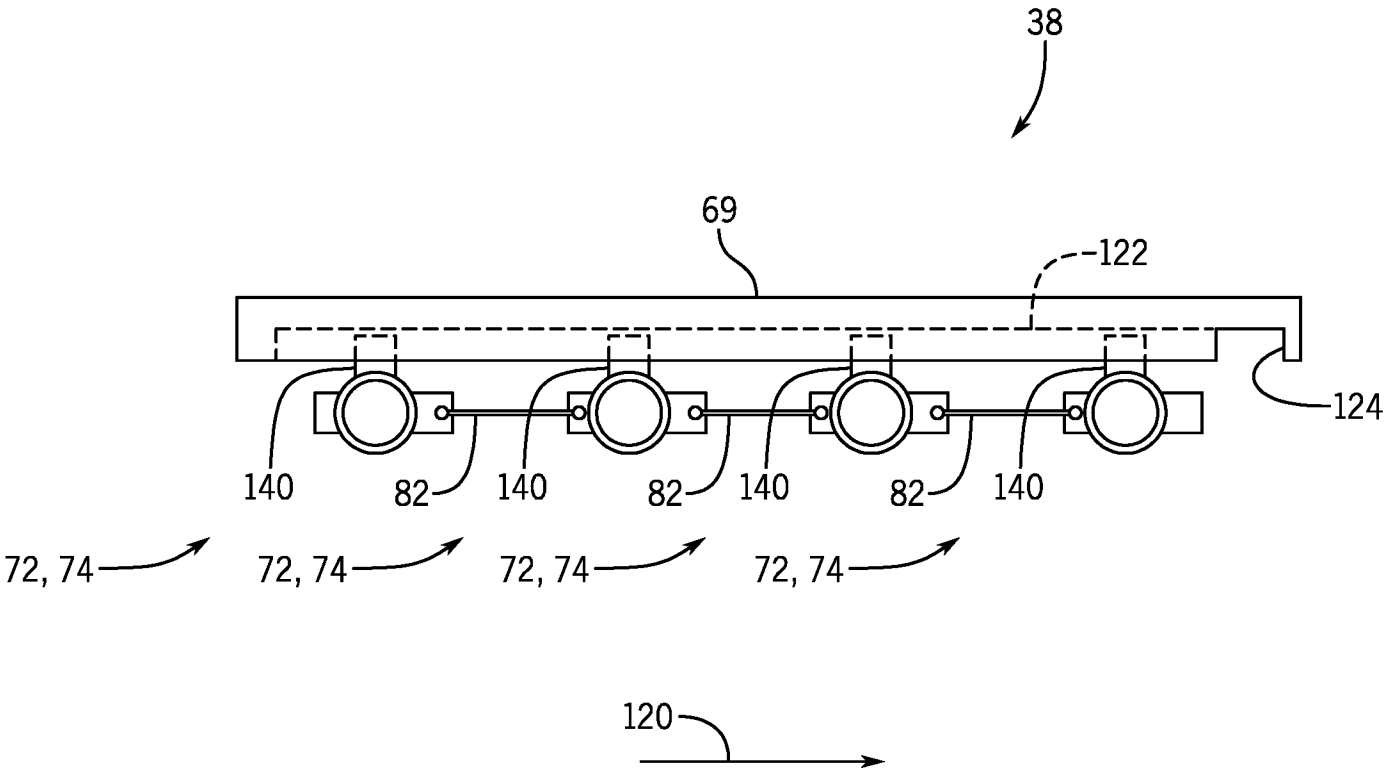
FIG. 4 is a top view of the string assembly system of FIG. 2 in accordance with an embodiment of the present disclosure.

FIG. 4 is a top view of the string assembly system 38. The conduits 60 are supported on the base 69 that organizes the conduits 60, facilitates transport, and enables rapid assembly of the conduits 60 into a string. In this way, the conduits 60 may be coupled together without being axially aligned and/or assembled. For example, the conduits 60 may be placed next to each other in a parallel layout or substantially parallel layout when not in use. The base 69 includes the track 122 that receives respective pins 140 coupled to the conduits 60. The pins 140 enable the conduits to couple to the base 69 (e.g., for transport, for storage) while simultaneously enabling the conduits 62 to slide in direction 120 towards the track outlet 124. As explained above, the conduits 60 are assembled in sequential order and then progressively disconnected from the base 69 as they are assembled into a string. Accordingly, the pins 140 enable the conduits 60 to slide towards the track outlet 124 as each conduit 60 is progressively added to the string. In some embodiments, instead of pins 140 the conduits 60 may magnetically couple to the base 69. A magnetic coupling may enable the conduits 60 to slide and/or rotate while blocking separation of the conduits 60 from the base 69 prior to assemble into the string.

Figure 5:
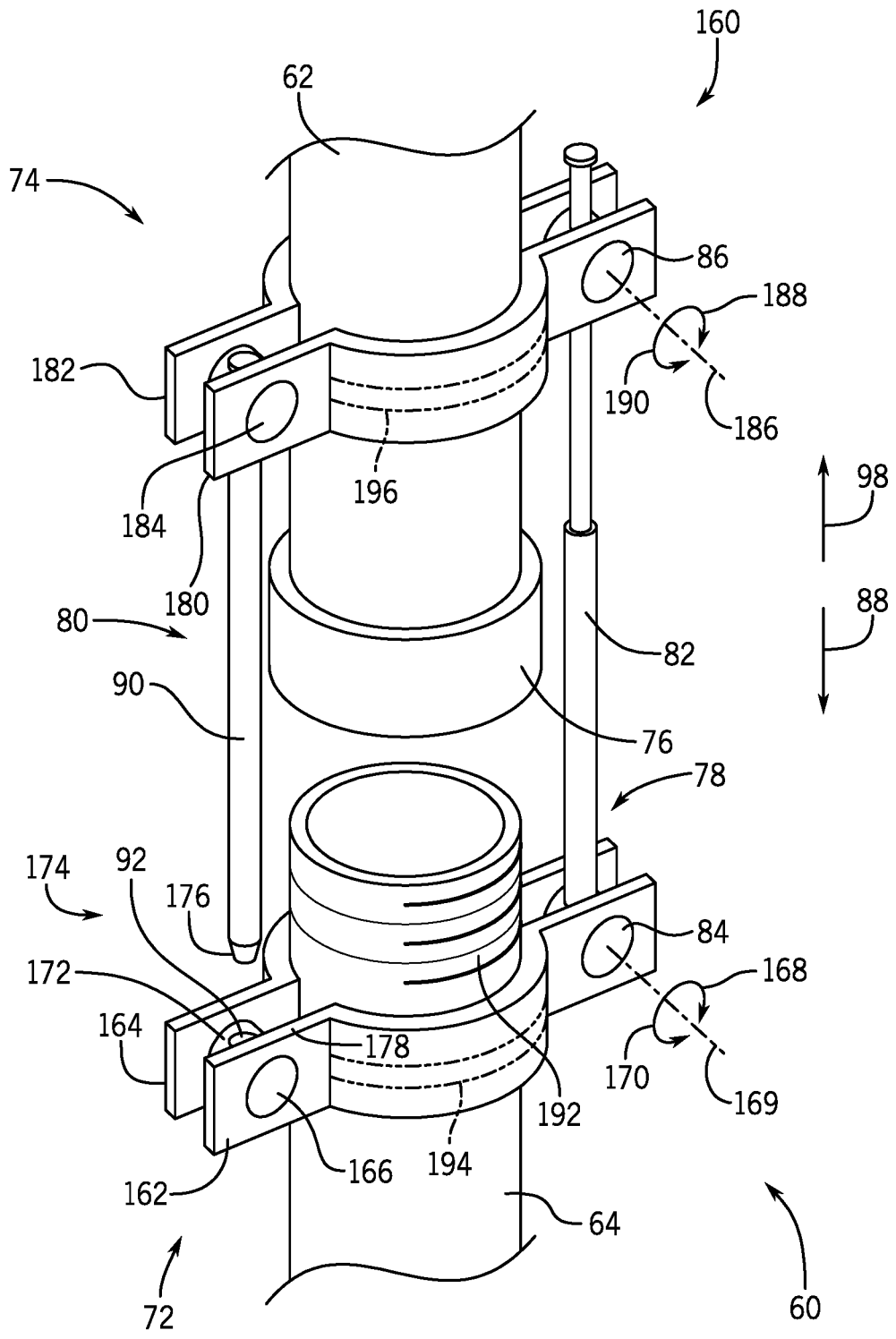
FIG. 5 is a perspective view of a portion of a string assembly system in accordance with an embodiment of the present disclosure.

FIG. 5 is a perspective view of a string assembly system 160. The string assembly system 160 includes the first connector assembly 72 (e.g., a first clamp assembly), the second connector assembly 74 (e.g., a second clamp assembly), and the connector 76. As illustrated, the first connector assembly 72 couples to the first end 78 of the conduit 64, the second connector assembly 74 couples to the second end 80 of the conduit 62, and the connector 76 couples to the second end 80 of the conduit 62.

The first connector assembly 72 includes a first bracket 162 and a second bracket 164 that couple together about the conduit 64 with pins 84 and 166. In addition to coupling to the first bracket 162 and the second bracket 164, the pin 84 couples to the rod or shaft 82. In operation, the pin 84 is configured to rotate about its axis 169 in either circumferential direction 168 or 170 to enable the conduit 62 to rotate relative to the conduit 64 while remaining connected. In contrast, the pin 166 is configured to be fixed (e.g., does not rotate) relative to the first bracket 162 and the second bracket 164. The pin 166 defines a recess or receptacle 172 that is configured to receive an end 174 of the alignment shaft 90. In some embodiments, the alignment shaft 90 may have a tapered end 176 that engages a tapered surface 178 of the receptacle 172. These tapered surfaces may facilitate alignment and coupling of the alignment shaft 90 with the first connector assembly 72.

The second connector assembly 74 similarly includes a first bracket 180 and a second bracket 182 that couple together about the conduit 62 with pins 86 and 184. The pin 86 couples to the rod or shaft 82, which couples the first connector assembly 72 to the second connector assembly 74. The pin 86 is able to rotate about its axis 186 in either circumferential direction 188 or 190 to enable the conduit 64 to rotate relative to the conduit 62. However, in some embodiments, the pin 184 is fixed (i.e., does not rotate) relative to the first bracket 180 and the second bracket 182. The pin 184 may be fixed in order to facilitate coupling of the alignment shaft 90 to the pin 166. The alignment shaft 90 couples to the pin 166 by lowering the conduit 62 in direction 88 and/or by lifting the conduit 64 in direction 98.

As the alignment shaft 90 enters the receptacle 172, the first and second connector assemblies 72, 74 align the connector 76 with the end 78 of the conduit 64. The connector 76 may then couple the conduit 62 to the conduit 64, which adds conduit 64 to the string. For example, the connector 76 may be threadingly coupled to threads 192 on the first end 78 of the conduit 64. It should be understood that while a single first connector assembly 72, second connector assembly 74, and connector 76 are illustrated in FIG. 5, the string assembly system 160 may include additional first connector assemblies 72, second connector assemblies 74, and connectors 76 to couple additional conduits 60 together to form a string.

In some embodiments, the first connector assembly 72 and/or the second connector assembly 74 may include bearings. For example, the first connector assembly 72 may include one or more bearings 194 between the brackets 162 and 164; and the conduit 64. Likewise, the second connector assembly 74 may include one or more bearings 196 between the brackets 180 and 182; and the conduit 62. In operation, the bearings 194 and 196 enable the first and second connector assemblies 72 and 74 to rotate relative to the conduits 62 and 64. The ability of the string assembly system 160 (e.g., first connector assembly 72 and/or second connector assembly 74) to rotate relative to the conduits 60 enables the string assembly system 160 to couple together a drilling string. More specifically, by enabling rotation, the string assembly system 160 is able to couple conduits 60 together while still enabling the drill string to drill as well as enable additional conduits to couple to the drill string (e.g., conduits 60 that have not been added to the string).

Figure 6:
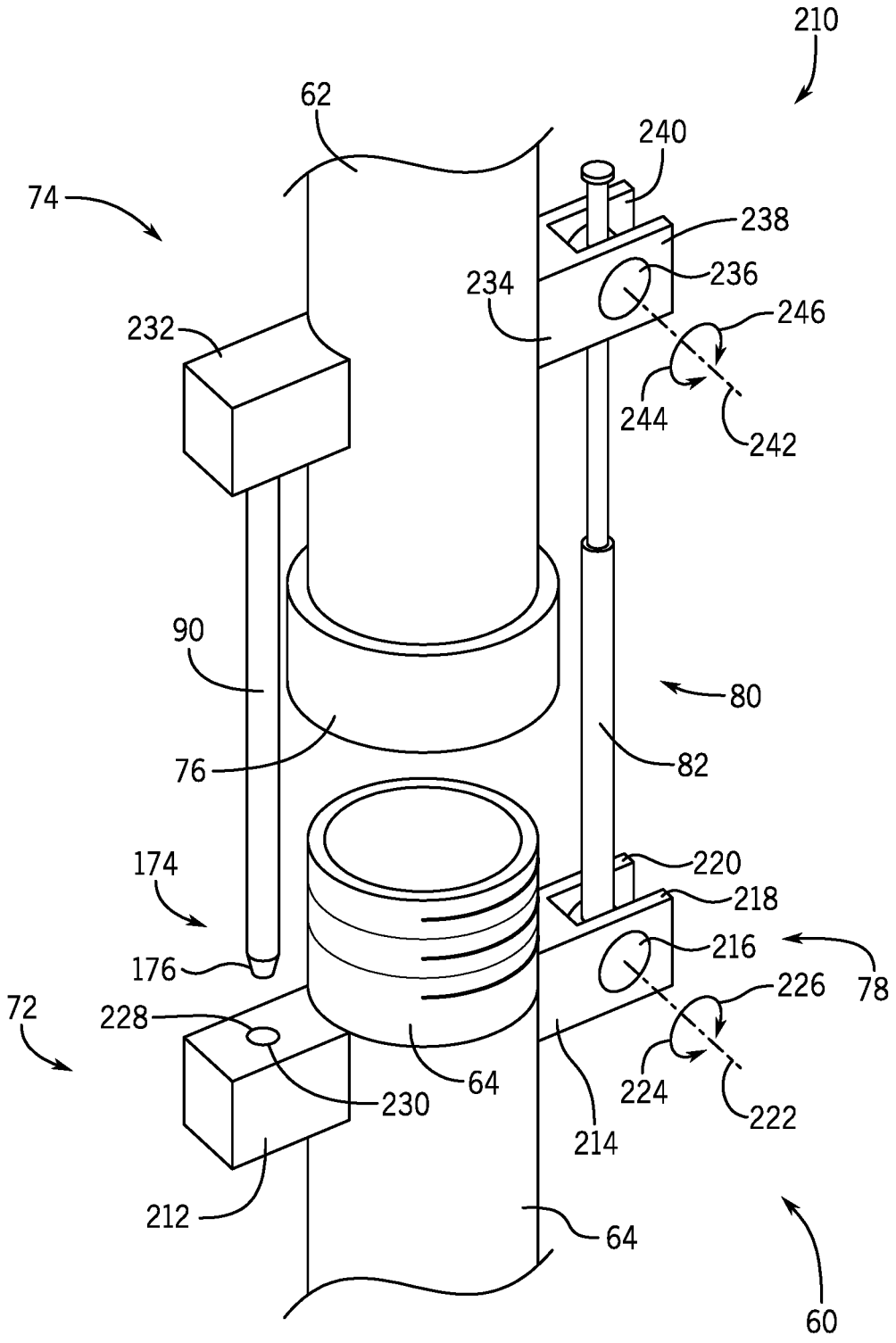
FIG. 6 is a perspective view of a portion of a string assembly system in accordance with an embodiment of the present disclosure.

FIG. 6 is a perspective view of a string assembly system 210. The string assembly system 210 includes the first connector assembly 72, the second connector assembly 74, and the connector 76. As illustrated, the first connector assembly 72 couples to the first end 78 of the conduit 64, the second connector assembly 74 couples to the second end 80 of the conduit 62, and the connector 76 couples to the second end 80 of the conduit 62.

The first connector assembly 72 includes first and second flanges 212, 214 that couple to the conduit 64. For example, the flanges 212, 214 may be welded to the conduit 64 or formed integrally with the conduit 64 (e.g., one-piece). As illustrated, the second flange 214 includes a pin 216 that couples to and extends between opposing walls 218 and 220 of the second flange 214. The pin 216 also couples to the rod or shaft 82. In operation, the pin 84 is configured to rotate about its axis 222 in either circumferential direction 224 or 226 to enable the conduit 62 to rotate relative to the conduit 64.

As illustrated, the first flange 212 defines a recess or receptacle 228 that is configured to receive an end 174 of the alignment shaft 90. In some embodiments, the alignment shaft 90 may have a tapered end 176 that engages a tapered surface 230 of the receptacle 228. These tapered surfaces may facilitate alignment and coupling of the alignment shaft 90 with the first connector assembly 72.

The second connector assembly 74 similarly includes a first and second flange 232 and 234 that couple to the conduit 62. For example, the flanges 232, 234 may be welded to the conduit 62 or formed integrally with the conduit 62 (e.g., one-piece). As illustrated, the second flange 234 includes a pin 236 that couples to and extends between opposing walls 238 and 240 of the second flange 214. The pin 236 also couples to the rod or shaft 82. In operation, the pin 236 is configured to rotate about its axis 242 in either circumferential direction 244 or 246 to enable the conduit 64 to rotate relative to the conduit 62.

As illustrated, the second connector assembly 74 couples to the alignment shaft 90. For example, the alignment shaft 90 may be welded, threadingly coupled, or formed integrally with the first flange 232 (e.g., formed from one-piece). In operation, the alignment shaft 90 is inserted into the recess or receptacle 228 to align the connector 76 with the end 78 of the conduit 64. Once aligned, the connector 76 couples the conduit 62 to the conduit 64. For example, the connector 76 may be threadingly coupled to the threads 192 on the end 78 of the conduit 64.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The invention claimed is:

1. A string assembly system, comprising:

a first conduit defining a first end and a second end;

a second conduit defining a third end and a fourth end;

a first connector assembly coupled to the second end of the first conduit, the first connector assembly comprises:

a first connector shaft configured to rotate relative to the first conduit and the second conduit; and a first alignment shaft configured to axially align the first conduit and the second conduit; and a second connector assembly coupled to the third end of the second conduit, wherein the second connector assembly couples to the first connector shaft, and wherein the first conduit is configured to rotate relative to the second conduit while coupled with the first connector shaft to align the first conduit with the second conduit.

2. The system of claim 1, wherein the first connector assembly is configured to couple the second end of the first conduit to the third end of the second conduit to form a string.

3. The system of claim 1, comprising a third conduit defining a fifth end and a sixth end, wherein the third conduit is configured to couple to the second conduit.

4. The system of claim 3, comprising a third connector assembly coupled to the fourth end of the second conduit, the third connector assembly comprises:

a second connector shaft configured to rotate relative to the second conduit and the third conduit; and a second alignment shaft configured to axially align the second conduit and the third conduit.

5. The system of claim 4, comprising a fourth connector assembly coupled to the fifth end of the third conduit, wherein the fourth connector assembly couples to the second connector shaft to couple the second conduit to the third conduit and to enable the second conduit to rotate relative to the third conduit.

6. The system of claim 3, comprising a fifth connector assembly coupled to the fourth end of the second conduit, wherein the fifth connector assembly is configured to couple the fourth end of the second conduit to the fifth end of the third conduit.

7. The system of claim 1, wherein the first conduit and the second conduit couple to a base, and wherein the first conduit and the second conduit are configured to rotate and slide relative to the base to align with each other.

8. The system of claim 7, wherein the base comprises a slot configured to receive a first connector pin to couple to the first conduit and a second connector pin to couple to the second conduit.

9. The system of claim 7, wherein the first conduit and the second conduit magnetically couple to the base.

10. A string assembly system, comprising:

a first connector assembly configured to couple to a first conduit, the first connector assembly comprises:

a first connector shaft configured to rotate relative to the first conduit and to a second conduit, wherein the first connector shaft is a telescoping shaft that is configured to change lengths in response to a changing distance between the first conduit and the second conduit; and a second connector assembly configured to couple to the second conduit, wherein the second connector assembly couples to the first connector shaft to enable the first conduit to rotate relative to the second conduit.

11. The system of claim 10, comprising a first alignment shaft configured to axially align the first conduit and the second conduit.

12. The system of claim 10, wherein the first connector assembly is configured to couple the first conduit to the second conduit.

13. The system of claim 10, comprising a third connector assembly configured to couple to the second conduit, the third connector assembly comprises:

a second connector shaft configured to rotate relative to the second conduit and to a third conduit; and a second alignment shaft configured to axially align the second conduit and the third conduit.

14. The system of claim 13, comprising a fourth connector assembly configured to couple to the third conduit, wherein the fourth connector assembly couples to the second connector shaft to couple the second conduit to the third conduit and to enable the second conduit to rotate relative to the third conduit.

15. A method of assembling a string, comprising:

rotating a first conduit relative to a second conduit, wherein the first conduit and the second conduit are configured to couple together with a first connector shaft, and wherein the first conduit rotates relative to the second conduit while coupled with the first connector shaft;

axially aligning the first conduit and the second conduit along a longitudinal axis of the first conduit; and driving a first alignment shaft into a first receptacle.

16. The method of claim 15, comprising coupling a first end of the first conduit to a second end of the second conduit with a connector.

17. The method of claim 16, comprising rotating the connector about an exterior surface of the second conduit to couple the first conduit to the second conduit.

18. The method of claim 15, comprising rotating a third conduit relative to the second conduit, wherein the third conduit and the second conduit couple together with a second connector shaft.

19. The method of claim 18, comprising axially aligning the second conduit and the third conduit.

20. The method of claim 15, comprising driving a second alignment shaft into a second receptacle.

* * * * *